US005511275A

United States Patent [19]

Volpenhein et al.

[11] Patent Number: 5,511,275

[45] Date of Patent: Apr. 30, 1996

[54] TOOTHBRUSH EXHIBITING THREE-DIMENSIONAL BRISTLE PROFILE AND END ROUNDED BRISTLES FOR IMPROVED INTERPROXIMAL CLEANING WITHOUT INCREASING GUM IRRITATION

[75] Inventors: Daniel W. Volpenhein, Maineville; Elizabeth J. Mueller; Thomas J. Hall, both of Cincinnati, all of Ohio

[73] Assignee: The Procter & Gamble Company, Cincinnati, Ohio

[21] Appl. No.: 442,088

[22] Filed: May 16, 1995

Related U.S. Application Data

[63] Continuation of Ser. No. 81,954, Jun. 23, 1993, abandoned, which is a continuation of Ser. No. 865,771, Apr. 6, 1992, abandoned, which is a continuation of Ser. No. 780,371, Oct. 23, 1991, abandoned, which is a continuation of Ser. No. 540,032, Jun. 19, 1990, abandoned.

[51] Int. Cl.[6] ..... A46B 9/04

[52] U.S. Cl. ..... 15/167.1; 15/110; 15/DIG. 5

[58] Field of Search ..... 15/167.1, DIG. 5, 15/110, 186

[56] References Cited

U.S. PATENT DOCUMENTS

| | | | |
|---|---|---|---|
| 74,560 | 2/1868 | Maury . | |
| D. 243,568 | 3/1977 | Axelsson | D4/25 |
| 759,490 | 5/1904 | Yates . | |
| 803,995 | 11/1905 | Davenport . | |
| 958,371 | 5/1910 | Danek | 15/167.1 |
| 1,018,927 | 2/1912 | Sarrazin | 15/167.1 |
| 1,059,426 | 4/1913 | Barnes | 15/167.1 |
| 1,257,883 | 2/1918 | Kone | 15/167.1 |
| 1,360,615 | 11/1920 | Bolard . | |
| 1,664,797 | 4/1928 | Stone . | |
| 1,682,548 | 8/1928 | Bigoney . | |
| 1,796,001 | 3/1931 | Church . | |
| 1,901,646 | 3/1933 | Hicks | 15/167.1 |
| 2,066,068 | 12/1936 | Cooke | 15/167.1 |
| 2,097,987 | 11/1937 | Phillips | 15/167 |
| 2,114,947 | 4/1938 | Warsaw | 15/167 |
| 2,224,788 | 12/1940 | Jobst | 15/167 |
| 2,426,328 | 8/1947 | Wandel et al. | 300/21 |
| 2,445,657 | 7/1948 | Bennett | 15/167 |
| 2,567,080 | 9/1951 | Pifer | 15/167 |
| 2,631,320 | 3/1953 | Bressler | 15/167 |

(List continued on next page.)

FOREIGN PATENT DOCUMENTS

| | | | |
|---|---|---|---|
| 695325 | 12/1930 | France . | |
| 794580 | 2/1936 | France . | |
| 1012208 | 7/1952 | France . | |
| 1467935 | 2/1967 | France . | |
| 0027853 | 12/1907 | Germany . | |
| 2433956 | 2/1976 | Germany | 15/167.1 |
| 0471387 | 9/1937 | United Kingdom | 15/167.1 |

OTHER PUBLICATIONS

Article entitled "Quality Testing the Ends of Bristles of Toothbrushes for Children" by C. Kockapan and W. E. Wetzel.

Price List For Celluloid Brush Products, Supplement to the Main Catalog, Jos. Ed. Faller, Brush Manufacturer Todtnau (Baden), pp. 3–15. (Along with a translation of the cover page).

(List continued on next page.)

*Primary Examiner*—Timothy F. Simone
*Assistant Examiner*—Patrick F. Brinson
*Attorney, Agent, or Firm*—Michael J. D'Amelio; Michael E. Hilton; Kevin C. Johnson

[57] ABSTRACT

A toothbrush is provided for achieving improved interproximal cleaning without increasing gum irritation. The bristles of the toothbrush have a generally "V" shaped side profile. In addition, the exposed ends of all of the bristles are properly end rounded. The dimensions and shape of the "V" shape fall within a certain range, as does the stiffness of the bristles. These characteristics allow the bristles to penetrate into the interproximal areas with enough force to effectively clean these areas without causing irritation to the user's gums.

19 Claims, 7 Drawing Sheets

U.S. PATENT DOCUMENTS

| | | | |
|---|---|---|---|
| 2,797,424 | 7/1957 | Olson | 15/167 |
| 3,010,131 | 11/1961 | Kisky | 15/167 |
| 3,177,509 | 4/1965 | Cyzer | 15/28 |
| 3,188,673 | 6/1965 | Newman | 15/167 |
| 4,031,587 | 6/1977 | Dietrich | 15/167 R |
| 4,033,008 | 7/1977 | Warren et al. | 15/167 R |
| 4,268,933 | 5/1981 | Papas | 15/167.1 |
| 4,356,585 | 11/1982 | Protell et al. | 15/111 |
| 4,403,623 | 9/1983 | Mark | 132/84 R |
| 4,432,114 | 2/1984 | Goudsmit | 15/104.93 |
| 4,502,177 | 3/1985 | Beggs | 15/167 R |
| 4,524,478 | 6/1985 | Ross | 15/106 |
| 4,570,282 | 2/1986 | Kaufman et al. | 15/167.1 |
| 4,610,045 | 9/1986 | Rauch | 15/167.1 |
| 4,637,660 | 1/1987 | Weihrauch | 300/21 |
| 4,646,381 | 3/1987 | Weihrauch | 15/167 |
| 4,672,706 | 6/1987 | Hill | 15/167 R |
| 4,679,273 | 7/1987 | Okin | 15/167 R |
| 4,712,266 | 12/1987 | Yamaki | 15/167.1 |
| 4,724,569 | 2/1988 | Eguchi et al. | 15/167.1 |
| 4,847,936 | 7/1989 | Moglianesi et al. | 15/167.1 |
| 4,852,202 | 8/1989 | Ledwitz | 15/167.1 |
| 4,882,803 | 11/1989 | Rogers et al. | 15/167.1 |

OTHER PUBLICATIONS

Translation of Quality Testing the Ends of Bristles of Toothbrushes for Children, Zahnaertzliche Mitteilungen V. 77, #16, 1987, pp. 1740–1742, 1744–1745, Ten pages of sketches illustrating various brushes and a photograph of a toothbrush marketed by Lion Corporation.

Co–pending, commonly assigned Design Patent Application of Daniel W. Volpenhein, Elizabeth J. Mueller and David E. Theobald, Ser. No. 07/662/070, filed on February 28, 1991—Brush Bristle Section.

Co–pending commonly assigned Design Patent Application of Dale Harrigan, Daniel W. Volpenhein, Elizabeth J. Mueller and David E. Theobald, Ser. No. 07/662,069, filed on Feb. 28, 1991—Brush Bristle Section.

TOOTHBRUSH EXHIBITING THREE-DIMENSIONAL BRISTLE PROFILE AND END ROUNDED BRISTLES FOR IMPROVED INTERPROXIMAL CLEANING WITHOUT INCREASING GUM IRRITATION

This is a continuation of application Ser. No. 08/081,954, filed on Jun. 23, 1993, now abandoned which is a continuation of application Ser. No. 07/865,771, filed on Apr. 6, 1992, abandoned, which is a continuation of application Ser. No. 780,371, filed on Oct. 23, 1991 which is a continuation of application Ser. No. 540,032 filed on Jun. 19, 1990, all abandoned.

BACKGROUND OF THE INVENTION

1. Field of the Invention

The present invention relates to toothbrushes, and more particularly, to toothbrushes which exhibit a three-dimensional bristle profile to provide improved cleaning in interproximal areas without increasing gum irritation.

2. Description of the Prior Art

The fundamental purpose of toothbrushes is to remove plaque and debris from tooth surfaces, both along their outer surfaces and in the interproximal areas. Most commercially available toothbrushes clean the outer surfaces of teeth adequately. However, applicants have discovered that a substantial improvement in toothbrush performance may be realized by optimizing toothbrush design for interproximal cleaning without sacrificing cleaning on the facial, lingual, buccal, and occlusal surfaces and without increasing gum irritation which often accompanies any attempt to improve interproximal cleaning. In particular, the present invention comprises an improved toothbrush having a "V" shaped pattern when viewed in side profile in combination with several other important operating characteristics which, when concurrently met, will render the toothbrush particularly adept at accomplishing the aforementioned objectives.

Toothbrushes having a "V" shaped side profile are generally known to those skilled in the art. However, it is believed that these known prior art toothbrushes do not exhibit all of the operating characteristics identified hereinafter as important to achieving improved interproximal cleaning without increasing gum irritation. For example, most of these prior "V" shaped toothbrushes lack bristles which are properly end rounded. This is due to the fact that the three-dimensional bristle pattern on such known brushes is often formed by cutting the exposed ends of the bristles to the desired configuration after the tufts have been stapled to the brush head. This leaves bristle tips having sharp chisel pointed edges which are difficult to end round due to their three-dimensional configuration, particularly in the valleys. Although such brushes will provide improved interproximal cleaning, without properly end rounded bristles these toothbrushes will irritate the user's gums, oftentimes leading the user to abandon use of the brush. Clearly, the improved interproximal cleaning benefit will not be realized if people refuse to use the toothbrush. Consequently, it is important that the exposed ends of the bristles be properly end rounded to avoid unnecessarily irritating the user's gums.

In addition to proper end rounding of the exposed bristle tips, other important operating characteristics have been identified in "V" shaped toothbrushes of the present invention to achieve improved interproximal cleaning. In particular, the shape and size of the "V" and the overall stiffness of the bristles are important characteristics which must be optimized in accordance with the disclosure set forth in the present specification to provide all of the benefits of the present invention.

SUMMARY OF THE INVENTION

In accordance with one aspect of the present invention a toothbrush is provided which exhibits superior interproximal cleaning. The toothbrush includes an elongate member having a head portion. A multiplicity of bristles extend from the head portion of the elongate member and these bristles have their distal ends properly rounded to avoid irritation of the user's gums in use. The distal ends of the bristles form a substantially aligned generally "V" shaped pattern when viewed in side profile, with a peak-to-peak distance ranging from about 0.16 inches to about 0.30 inches and a peak height ranging from about 0.06 inches to about 0.18 inches. The bristles also exhibit a stiffness factor, as hereinafter defined, in the range of from about 0.2 to about 0.8.

BRIEF DESCRIPTION OF THE DRAWINGS

While the specification concludes with claims which particularly point out and distinctly claim the invention, it is believed the present invention will be better understood from the following description of several particularly preferred embodiments taken in conjunction with the accompanying drawings, in which like reference numerals identify similar elements and wherein;

DESCRIPTION OF PARTICULARLY PREFERRED EMBODIMENTS

Figure 1:
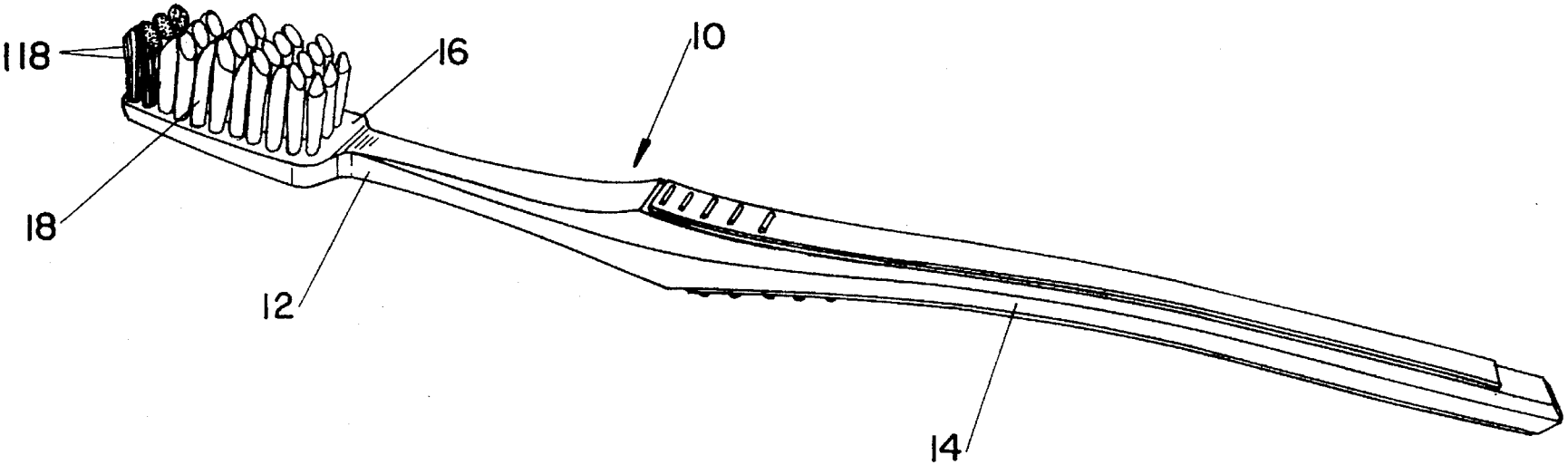
FIG. 1 is a perspective view of a preferred embodiment of a toothbrush of the present invention.

In a particularly preferred embodiment seen in FIG. 1, the present invention comprises a toothbrush, indicated generally as 10, for achieving improved interproximal cleaning without increasing gum irritation. Basically, the toothbrush 10 includes an elongate member 12 having a handle portion 14 and a head portion 16. For applications such as electric toothbrushes, the handle portion 14 may comprise suitable attachment means (not shown) for securing the brush head portion 16 to the driving means. The head portion 16 may comprise a generally rectangular area from which a multiplicity of bristle bundles or tufts 18 extend. The bristles 118 in tufts 18 are properly end rounded to protect gum tissue. A particularly preferred method for providing three-dimensionally profiled tufts 18 wherein the individual bristles 118 exhibit high quality end rounding will be discussed in detail in the latter portions of the present specification.

Figure 2:
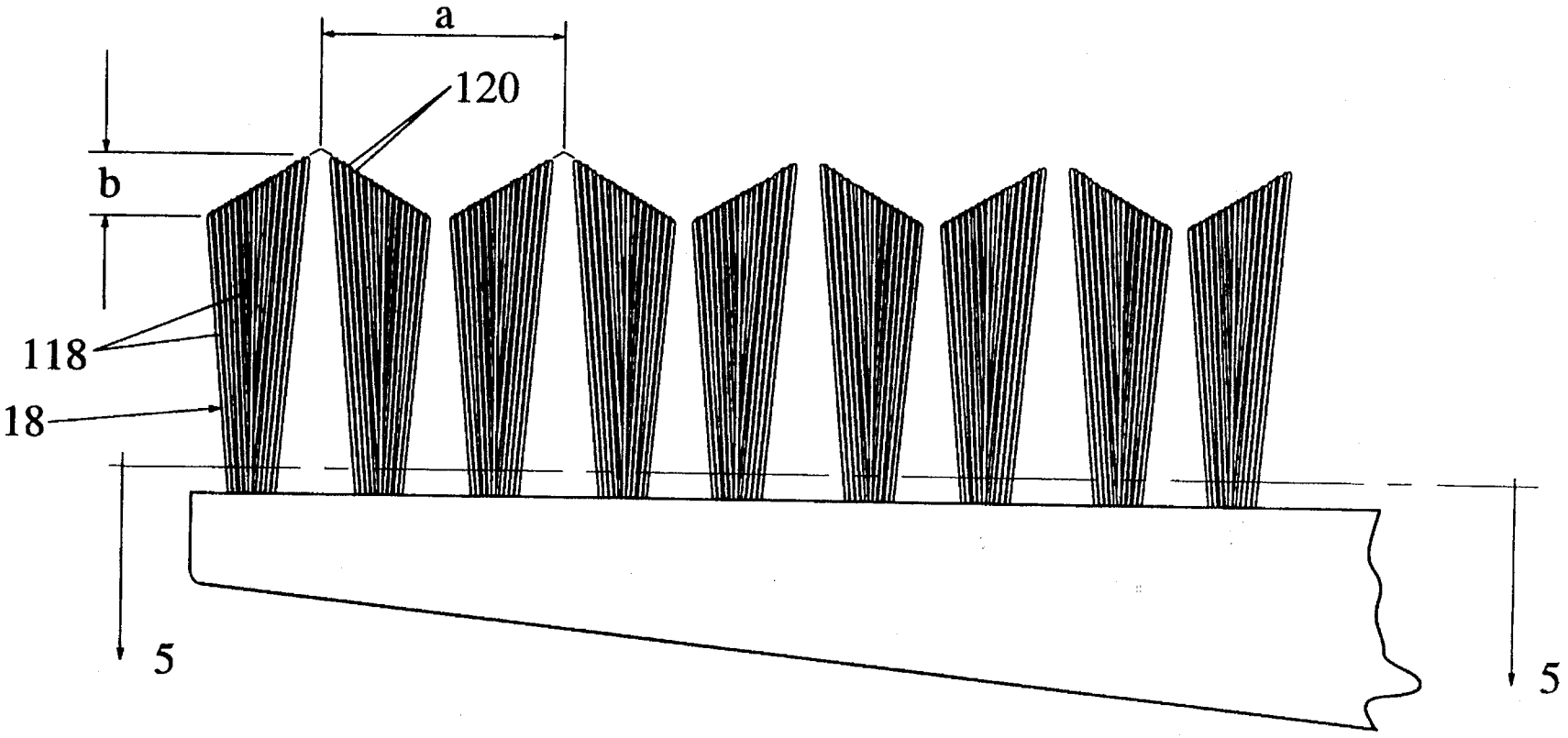
FIG. 2 is a side profile view of the toothbrush of FIG. 1 illustrating the straight "V" side profile.
Figure 3:
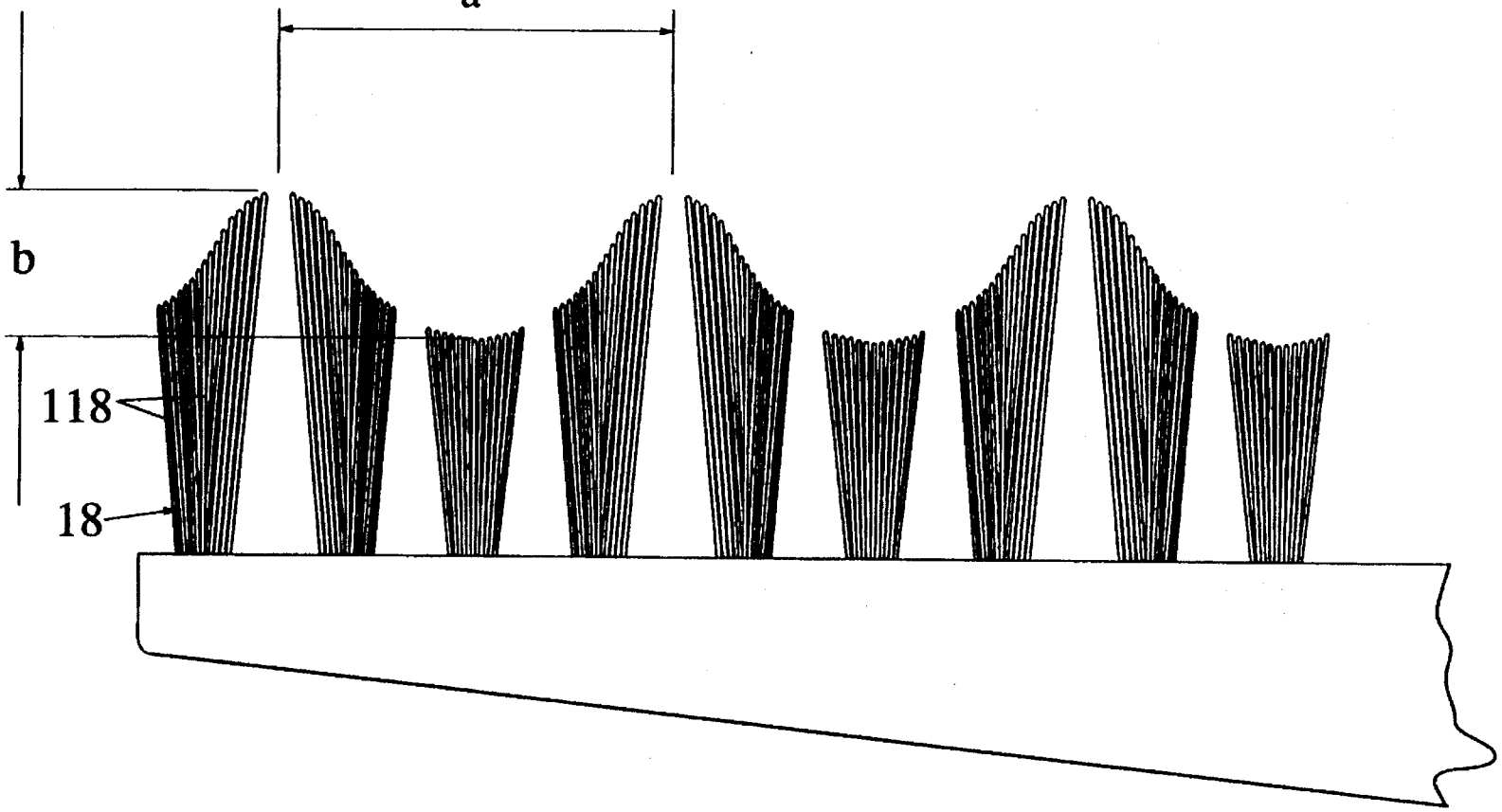
FIG. 3 is a side profile view similar to FIG. 2 of a second preferred embodiment of a toothbrush of the present invention having a sine wave "V" side profile.
Figure 4:
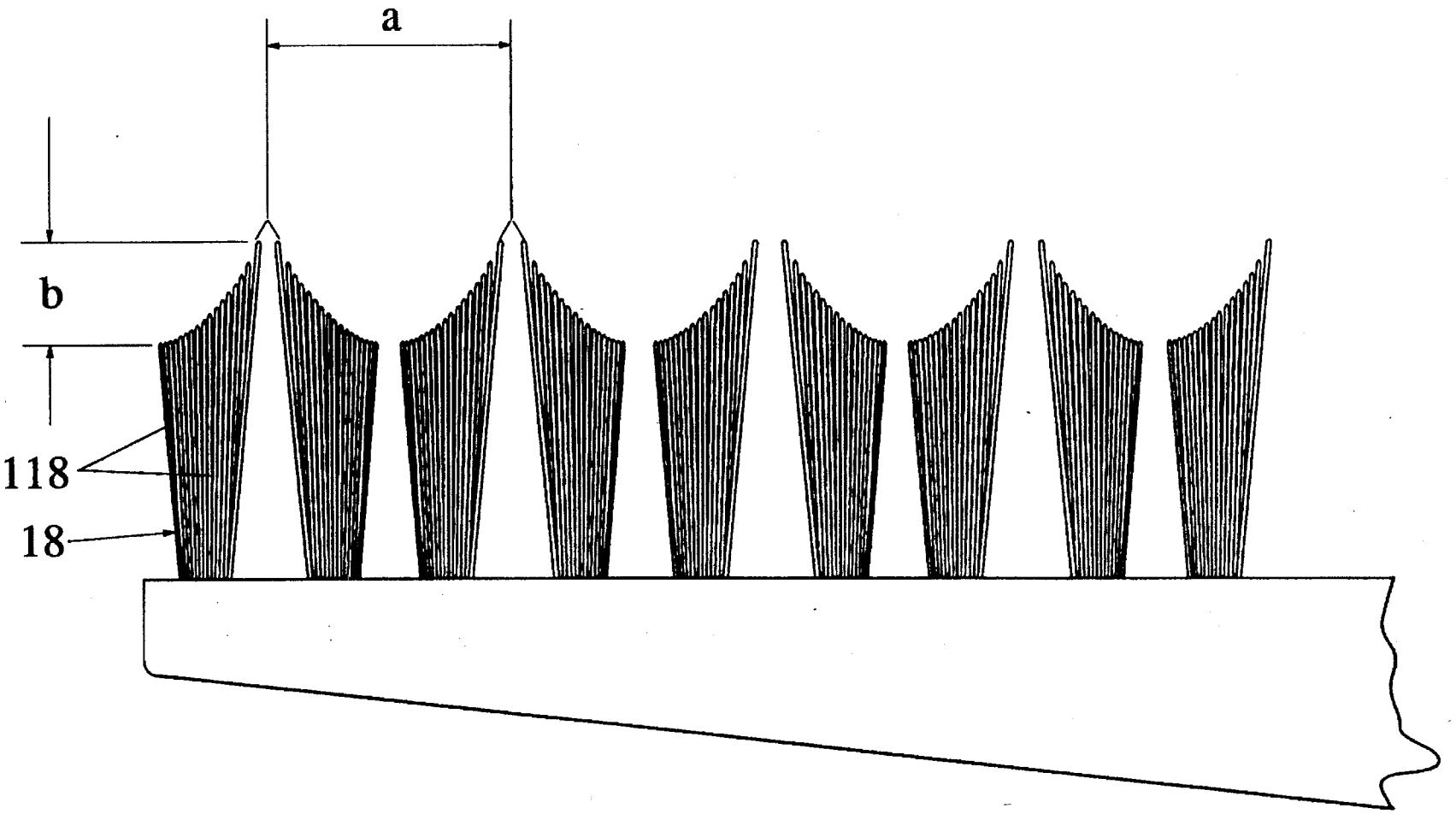
FIG. 4 is a side profile view similar to FIG. 2 of a third preferred embodiment of a toothbrush of the present invention having a scallop "V" side profile.

Referring to FIG. 2, the bristles 118 in tufts 18 are preferably arranged in a geometry which enables them to penetrate, or reach, into the interproximal areas between the user's teeth. Without sufficient penetration between the teeth, much of the interproximal area will remain untouched by the bristles of the brush. To increase interproximal penetration, the distal ends 120 of the bristles 118 form a substantially aligned "V" shaped side profile. The preferred toothbrush embodiment 10 of FIG. 1 has a substantially aligned straight-"V" shaped side profile, as best seen in FIG. 2. Possible modifications to the straight "V" shaped side profile include a sine wave-"V" as best seen in FIG. 3, or a scallop-"V" as best seen in FIG. 4.

Figure 5:
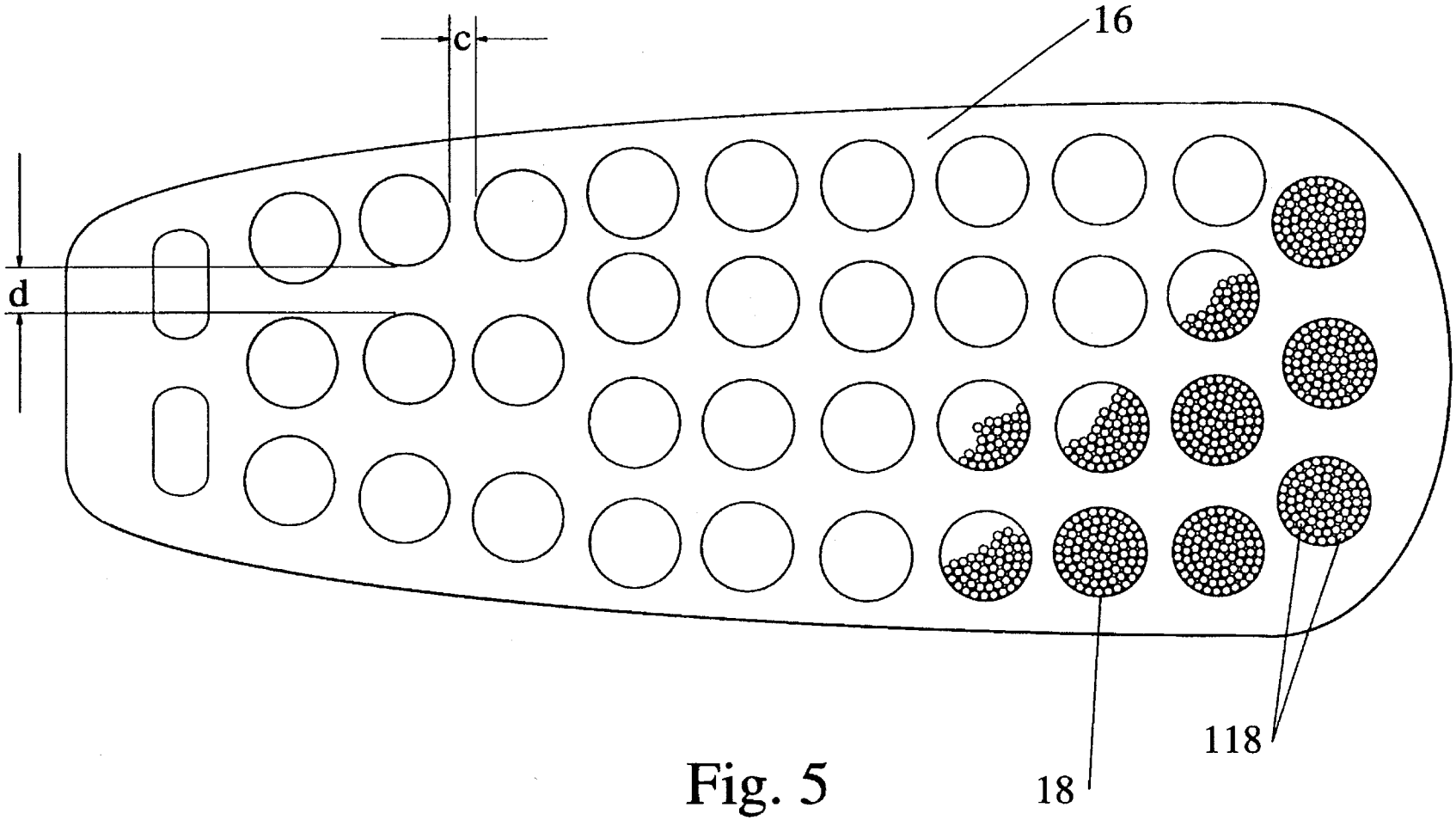
FIG. 5 is a cross-sectional plan view taken along line 5—5 of FIG. 2 showing the bristle tuft pattern.

Referring to FIG. 2 in conjunction with FIG. 5, the bristles 118 of toothbrush embodiment 10 form a straight-"V" shaped side profile having five and one-half peaks. For an adult sized toothbrush, the total number of peaks preferably ranges from about three to about seven. The bristles 118 which extend from the head portion 16 of the elongate member 12 are grouped together into a plurality of bundles or tufts 18. Each tuft 18 preferably includes bristles 118 of various lengths which helps increase the ability of each tuft 18 to reach into the interproximal areas. As can be seen in FIG. 2, although the individual bristles 118 within the tufts 18 exhibit good end rounding, the overall profile of each tuft 18 of the first ten rows is that of a single edged chisel. Since there is an odd number of rows the tufts 18 of the last row adjacent the handle portion 14 of the brush exhibit a double chisel or wedge shaped profile when viewed in side elevation to reduce stress on the last row, thereby increasing durability. Although FIG. 2 discloses the preferred configuration where two transverse rows of tufts form a peak, anywhere from one to three rows of tufts 18 may be used to form a peak and the number of tufts 18 per peak need not be consistent throughout the brush head 16. Likewise, as can be seen in FIG. 5 the number of tufts 18 per row need not be consistent throughout the brush head 16.

The distance from one peak to another peak (peak spacing) directly impacts the ability of the tuft 18 to penetrate into the interproximal zone. This peak spacing distance is indicated as "a" in FIGS. 2–4, and is the distance between the theoretical peaks if there is no actual peak. An acceptable peak spacing "a" is preferably defined according to average human teeth geometries, as represented by the Columbia DENTOFORM model R861, as available from The Columbia Dentoform Corporation of Long Island City, N.Y. The peak spacing range employed in the practice of the present invention is preferably about one third less than the average geometry range to allow for maximum bristle buckling and bending during the back-and-forth stroke of the brush. Consequently, for an average human tooth width of about 0.33", a minimum human tooth width of about 0.23" and a maximum human tooth width of about 0.46", as taken from the DENTOFORM model R861, the preferred peak spacing "a" for brushes of the present invention preferably ranges from about 0.16" to about 0.30", and even more preferably, from about 0.19" to about 0.23".

In addition to peak spacing, the depth of the "V" (peak height) also impacts interproximal penetration. This distance is indicated as "b" in FIGS. 2–4. It is the distance from the bottom to the top of the "V" on the tuft 18. Like peak spacing, the interproximal depth may be defined according to average teeth geometries based on the Columbia DENTOFORM model R861 described earlier herein. From the DENTOFORM model R861, the average interdental depth is about 0.14" with a range of from about 0.10" to about 0.17". Accordingly, the preferred peak height "b" in brushes of the present invention preferably ranges from about 0.06" to about 0.18", and even more preferably, from about 0.09" to about 0.16".

In addition to having peak spacing "a" and peak height "b" values within the appropriate ranges, peak spacing "a" is preferably about twice peak height "b".

This "V" shaped profile must be substantially aligned across the brush head in the transverse direction. Misalignment of the V shaped profile causes bristles to interfere with, i.e., contact, the outer surfaces of the user's teeth. If too many bristles interfere with adjacent teeth they reduce the ability of the bristles aligned with the interproximal areas to penetrate into the interproximal areas. Furthermore, better cleaning results when the tufts 18 of each row are preferably aligned with one another in the transverse direction, i.e., parallel to the width of the brush head 16 as seen best in FIG. 5. In other words, row alignment across the width occurs when the tufts 18 form a straight line, perpendicular to the lengthwise axis of the elongate member 12 (seen in FIG. 1). Therefore, the tufts 18 of each row are preferably aligned in the transverse direction.

Overall penetration is also affected by the longitudinal row spacing between adjacent tufts 18. Longitudinal row spacing is the longitudinal distance between adjacent tufts 18, as measured in a direction parallel to the length of elongate member 12, and is indicated as "c" in FIG. 5. Since longitudinal row spacing "c" may not be completely uniform throughout the head portion 16 of the toothbrush an average value is calculated. Increasing the longitudinal row spacing "c" allows more free movement of individual tufts 18 which tends to improve penetration. The longitudinal row spacing "c" preferably ranges from about 0.02 inches to about 0.08 inches, and even more preferably from about 0.04 inches to about 0.07 inches.

In addition to being able to penetrate into the interproximal areas, the bristles 118 on toothbrushes of the present invention must be sufficiently stiff to generate enough force to remove plaque and debris in these interproximal areas.

The bristles 118 in combination have a bristle stiffness which can be characterized numerically by the following equation:

$$\text{Bristle Stiffness} = \frac{D^2E}{X^2} * \frac{(\text{\# Bristles})}{1 \times 10^6}$$

where;

D=bristle diameter, in inches

E=modulus of elasticity of the bristle material when wet, e.g. for nylon this is a constant, 460,000 psi X=average bristle length across the head 16 of the brush in inches # bristles=total number of bristles on brush head 16

The bristle stiffness for brushes of the present invention, as determined by the above equation, preferably ranges from about 0.2 to about 0.8.

The initial stiffness calculation, $$\frac{D^2E}{X^2}$$

for an individual bristle 118 is a measure of the pressure produced by the minimum force required to deflect a single bristle 118 according to *The Stiffness of Toothbrushes*, D. W. MacFarlane, Brit. Dent. Jour., Oct. 5, 1945, which is hereby incorporated herein by reference. Bristle stiffness is obtained by multiplying this single bristle stiffness value by the total number of bristles 118 on the brush head 16. The factor $1\times10^6$ used in the denominator of the foregoing equation is an arbitrarily selected constant which reduces the overall bristle stiffness value to reasonably small numbers for ease of comparison.

The diameter "D" of bristles 118 employed in toothbrushes of the present invention preferably ranges from about 0.006 inches to about 0.009 inches. Average bristle length "X" preferably ranges from about 0.30 inches to about 0.55 inches and even more preferably from about 0.34 inches to about 0.44 inches. The total number of bristles 118 in the head portion 16 of brushes of the present invention is preferably from about 1,200 to about 5,000, and even more preferably from about 1,600 to about 3,500.

In addition to the foregoing bristle stiffness characteristic, buttressing also effects stiffness. Buttressing is the tendency of adjacent bristles to support or buttress each other. Within a tuft, more tightly packed bristles 118 provide additional support adding to the effective stiffness of the bristles 118. Optimum Buttressing occurs when all bristles 118 are touching, i.e. no staple is used. In this case the number of bristles 118 in a hole are maximized and the tight packing maximizes the degree of support these bristles 118 give to each other. Since buttressing is a measure of the efficiency by which a tuft 18 of bristles 118 are packed together, a numerical value, termed Buttress Factor, is achieved by dividing the cross-sectional area taken up by the bristles 118 by the total cross sectional area of the tuft 18 at the base. Numerically, the preferred Buttress Factor for brushes of the present invention ranges from about 0.8 to about 0.96.

Buttressing from tuft to tuft also effects stiffness. Tuft to tuft interaction between columns is affected by the transverse column spacing, indicated as "d" in FIG. 5. Like longitudinal row spacing "c", transverse column spacing "d" may not be completely uniform throughout the head portion 16 of the toothbrush, therefore, an average value is used.

Figure 7:
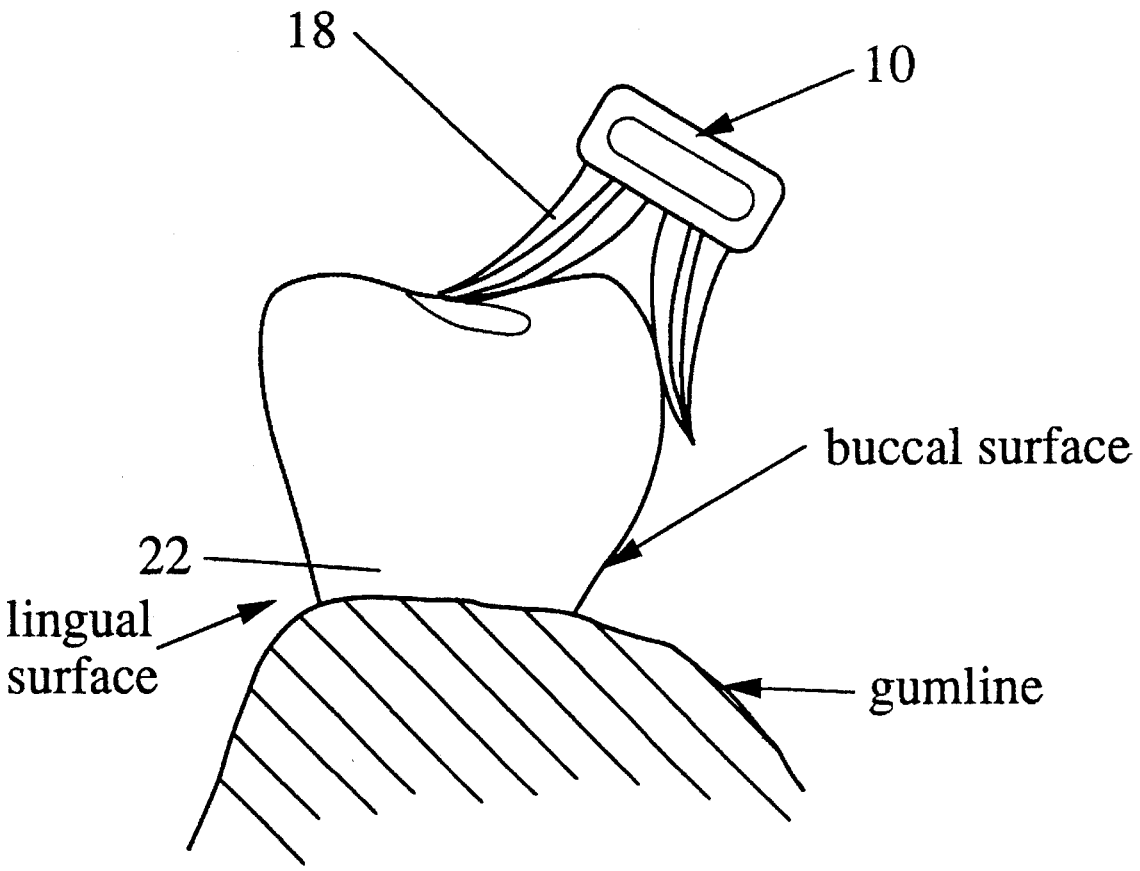
FIG. 7 is an end view of the toothbrush showing its position on a tooth during brushing.

Reducing transverse column spacing "d" effectively increases the overall bristle stiffness of tufts 18. As seen in FIG. 7, with the typical back-and-forth stroke, i.e., in and out of the plane of the paper on which FIG. 7 appears, and a generally 45 degree brush head angle in relation to the exposed surfaces of tooth 22, adjacent tufts in a row are spread out across the crowns of the tooth 22. As they are spread, closer transverse column spacing "d" effectively increases the overall bristle stiffness of the brush as the outer tufts 18 support the inner tufts 18, forcing them into interproximal spaces between adjacent teeth.

Figure 6:
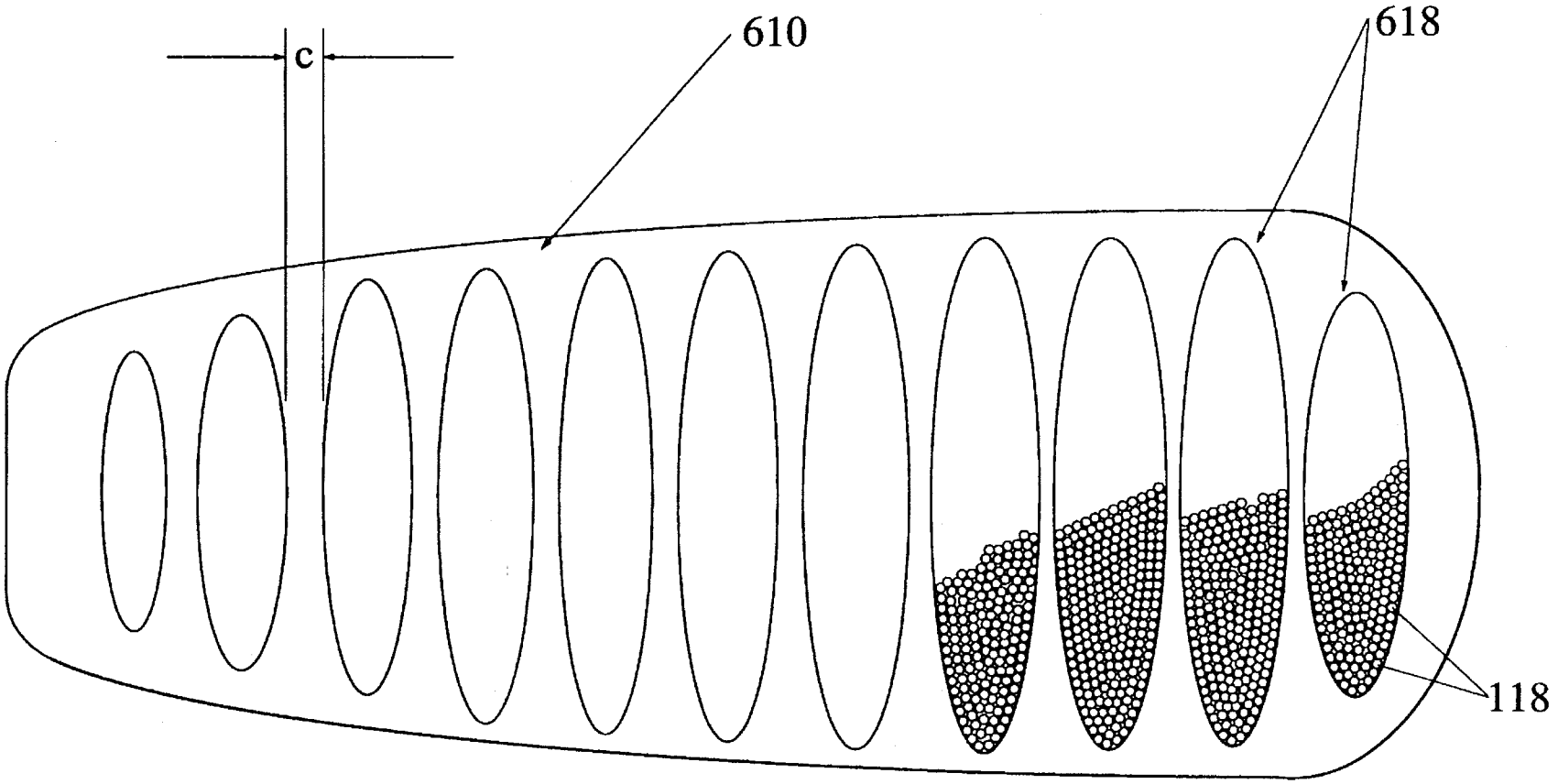
FIG. 6 is a cross sectional plan view similar to FIG. 5 illustrating an alternative bristle tuft pattern.

The toothbrush embodiment 610 of FIG. 6 effectively eliminates the transverse column spacing "d" between adjacent tufts 618, since each tuft 618 extends substantially continuously across the width of the brush head. The tufts 618 of the illustrated embodiment are oblong, although they could also be oval or rectangular. Due to the beneficial effects of tuft to tuft buttressing between columns, transverse column spacing is preferably from zero to about 0.08 inches.

Tuft to tuft interaction between rows is affected by the longitudinal row spacing "c". The previously noted preferred ranges for longitudinal row spacing "c" reflects a balance between desired penetration for interproximal cleaning and desired buttressing for surface scrubbing.

A preferred method of achieving end rounded bristles 118 in a "V" shaped format is to first square cut or shear a group of bristles 118 perpendicular to the length of the bristles 18. The cut ends of the bristles 118 are then ground while in a common plane to remove any sharp or protruding edges from each bristle 118. The bristles 118 are then moved relative to each other to produce a desired three-dimensional shape at the exposed end of the tuft 18. The attachment end of the bristles 118 are then preferably square cut or sheared to the appropriate length. This method is further described in German Patent Application 3820372 which published on Dec. 20, 1989, which is hereby incorporated herein by reference. The attachment end of the bristles 118 is then preferably heated to form a molten mass and placed against the heated head portion 16 of the elongate member 12. As the molten materials cool, the tufts are secured to the head portion 16 of the elongate member 12. The latter method is further described in U.S. Pat. No. 4,637,660 which issued on Jan. 20, 1987 to Weihrauch, which is also hereby incorporated herein by reference.

The dimensions and characteristics of one exemplary toothbrush embodiment similar to that illustrated in FIG. 1 may include the following;

| | |
|---|---|
| *Fundamental Parameters | |
| "V" profile - 5½ peaks | |
| Rows aligned | |
| Square-cut, optimally end-rounded bristles which are three-dimensionally contoured after end rounding | |
| *Optimized Parameters | |
| Stiffness | |
| - bristle diameters | .007" |
| - bristle length | .35–.43" (avg. = .39) |
| - total number of bristles | 2052 |
| Stiffness = .30 | |
| Buttressing | |
| - Buttress Factor | 0.87 |
| - "d" | .05" |
| Penetration | |
| - peak spacing | .22" |
| - peak height | .09" |
| - alignment | total |
| - "c" | .05" |
| Overall head size (0.71" to 1.3" × 0.32" to 0.50") | |

The dimensions and characteristics of a second preferred embodiment similar to that illustrated in FIG. 6 may include the following:

| | |
|---|---|
| *Fundamental Parameters | |
| "V" profile - 5½ peaks | |
| Rows aligned | |
| Square-cut, optimally end-rounded bristles which are three-dimensionally contoured after end rounding | |
| *Optimized Parameters | |
| Stiffness | |
| - bristle diameters | .007" |
| - bristle length | .35–.43" (avg. = .39) |
| - total number of bristles | 3800 |
| Stiffness = .56 | |
| Buttressing | |
| - Buttress Factor | 0.87 |
| - "d" | 0.0" |
| Penetration | |
| - peak spacing | .22" |
| - peak height | .1" |
| - alignment | total |
| - "c" | .05" |
| Overall head size (0.71" to 1.3" × 0.32" to 0.50") | |

Although particular embodiments of the present invention have been shown and described, modification may be made to the toothbrush without departing from the teachings of the present invention. Accordingly, the present invention comprises all embodiments within the scope of the appended claims.

What we claim is:

1. A toothbrush exhibiting superior interproximal cleaning without increasing gum irritation comprising:

(a) an elongate member having a head portion;

(b) a multiplicity of bristles, substantially all of said bristles being end rounded, said bristles being cut to form a distal end and an attachment end, the distal end of said bristles being ground while in a common plane, said bristles being moved relative to each other so that the distal ends of said bristles, in combination, form a substantially aligned generally "V" shaped side profile, a plurality of peaks and a plurality of troughs, said peaks and troughs being defined by said generally "V" shaped side profile, a distance between adjacent peaks of from about 0.19 inches to about 0.23 inches, and a peak to trough distance of from about 0.09 inches to about 0.16 inches, the bristles further having a stiffness in the range from about 0.2 psi to about 0.08 psi and a Buttress Factor from about 0.8 to about 0.96, the attachment end of said bristles being cut to a common plane and secured to the head portion of the elongate member.

2. A toothbrush according to claim 1 wherein the total number of bristles extending from the brush head is from about 1600 to about 3500.

3. A toothbrush exhibiting superior interproximal cleaning without increasing gum irritation and including a multiplicity of bristles, said toothbrush comprising:

(a) an elongate member having a head portion;

(b) a multiplicity of bristles extending from the head portion of the elongate member, said bristles having distal ends forming a substantially aligned generally "V" shaped side profile, a plurality of peaks and a plurality of troughs, said peaks and troughs being defined by said generally "V" shaped side profile, a distance between adjacent peaks "a" of from about 0.19 inches to about 0.23 inches, and a peak to trough distance "b" of from about 0.09 inches to about 0.16 inches, the bristles further having a stiffness in the range from about 0.2 psi to about 0.8 psi and a Buttress Factor from about 0.8 to about 0.96.

4. A toothbrush according to claim 3 wherein each bristle is in contact with all adjacent bristles at the point of attachment to the head portion of the elongate member.

5. A toothbrush according to claim 1 wherein each bristle is in contact with all adjacent bristles at the point of attachment to the head portion of the elongate member.

6. A toothbrush according to claim 3 wherein the peak spacing "a" is twice the peak height "b".

7. A toothbrush according to claim 1 wherein the head portion has a longitudinal length from about 0.71 inches to about 1.30 inches and a transverse dimension from about 0.32 inches to about 0.50 inches.

8. A toothbrush according to claim 3 further comprising a plurality of bristle tufts, each tuft being secured to said head portion and having a longitudinal row spacing between said bristle tufts of from about 0.02 inches to about 0.08 inches.

9. A toothbrush according to claim 1 further comprising a plurality of bristle tufts, each tuft being secured to said head portion and having a longitudinal row spacing between said bristle tufts of from about 0.02 inches to about 0.08 inches.

10. A toothbrush according to claim 3 further comprising a plurality of bristle tufts, each tuft being secured to said head portion and having a transverse column spacing between said bristle tufts of from about zero to about 0.08 inches.

11. A toothbrush according to claim 1 further comprising a plurality of bristle tufts, each tuft being secured to said head portion and having a transverse column spacing between said bristle tufts of from about zero to about 0.08 inches.

12. A toothbrush according to claim 1 wherein the total number of bristles extending from the brush head is from about 1,200 to about 5,000.

13. A toothbrush according to claim 3 wherein the average bristle length is from about 0.35" to about 0.43".

14. A toothbrush according to claim 1 wherein the average bristle length is from about 0.35" to about 0.43".

15. A toothbrush according to claim 3 wherein the "V" shaped pattern includes three to seven peaks.

16. A toothbrush according to claim 1 wherein the "V" shaped pattern includes three to seven peaks.

17. A toothbrush according to claim 3 wherein the head portion has a longitudinal length from about 0.71 inches to about 1.30 inches and a transverse dimension from about 0.32 inches to about 0.50 inches.

18. A toothbrush according to claim 1 wherein the head portion has a longitudinal length from about 0.71 inches to about 1.30 inches and a transverse dimension from about 0.32 inches to about 0.50 inches.

19. A toothbrush according to claim 3 wherein the total number of bristles extending from the brush head is from about 1600 to about 3500.

* * * * *